US008262396B2

(12) United States Patent
Sun et al.

(10) Patent No.: US 8,262,396 B2
(45) Date of Patent: Sep. 11, 2012

(54) ELECTRICAL CONNECTOR WITH A HANDLING PORTION WITH A COVER

(75) Inventors: Yun-Song Sun, Kunshan (CN); Chien-Hsun Huang, New Taipei (TW)

(73) Assignee: Hon Hai Precision Ind. Co., Ltd, New Taipei (TW)

( * ) Notice: Subject to any disclaimer, the term of this patent is extended or adjusted under 35 U.S.C. 154(b) by 0 days.

(21) Appl. No.: 13/013,763

(22) Filed: Jan. 25, 2011

(65) Prior Publication Data

US 2011/0183534 A1 Jul. 28, 2011

(30) Foreign Application Priority Data

Jan. 25, 2010 (CN) ..... 2010 2 0301391

(51) Int. Cl.
*H01R 13/62* (2006.01)

(52) U.S. Cl. ..... 439/157

(58) Field of Classification Search ..... 439/152–160
See application file for complete search history.

(56) References Cited

U.S. PATENT DOCUMENTS

| | | | | |
|---|---|---|---|---|
| 6,731,510 | B1 * | 5/2004 | Hwang et al. | 361/754 |
| 6,739,888 | B2 * | 5/2004 | Kato et al. | 439/157 |
| 7,699,629 | B2 * | 4/2010 | Sasser et al. | 439/108 |
| 7,866,993 | B2 * | 1/2011 | Ohsumi | 439/141 |
| 2003/0216072 | A1 * | 11/2003 | Kato et al. | 439/157 |

FOREIGN PATENT DOCUMENTS

TW M360457 7/2009

* cited by examiner

*Primary Examiner* — Chandrika Prasad
(74) *Attorney, Agent, or Firm* — Wei Te Chung; Andrew C. Cheng; Ming Chieh Chang

(57) ABSTRACT

An electrical connector includes a housing, a plurality of contacts received in the housing, a shielding and a handling portion. The housing includes a mating portion and a connecting portion. The shielding includes a first upper cover and a second down cover respectively assembled on the housing from up to down and from down to up. The upper cover and the down cover respectively includes a pair of extending arm to combine to form a fastening portion located on the two sides of the shielding. The handling portion is fixed on the fastening portion and includes a connecting element, and a cover over mode on the connecting element, a pair of fastening arms inserted into the fastening portion of the shielding. The cover is apart from the housing.

13 Claims, 4 Drawing Sheets

ELECTRICAL CONNECTOR WITH A HANDLING PORTION WITH A COVER

BACKGROUND OF THE INVENTION

1. Field of the Invention

The present invention relates generally to an electrical connector, and more particularly to an electrical connector with an improved handling portion for being used in a movable electronic device.

2. Description of the Prior Art

Nowadays, with the prevalence of consumer electronics, it is commonplace to transfer and process all kinds of data through electronic products. Generally, electronic products or electronic components must be connected via electric connectors in order to implement two-way data transfer. Low-voltage differential signaling (LVDS) connectors are among the most popular electric connectors of today and are usually used in electronic devices to transmit high-voltage and low-voltage signals. For protecting the connection between cables and contacts of the LVDS connectors, LVDS connectors always comprises a handling portion to pull the LVDS connectors out from complementary connectors.

TW Patent No. M360457, issued by Wang on Jul. 1, 2009, disclosed a LVDS connector including a base portion, an insulation housing, a cover and a handling portion. However, the handling portion is too thin to fit for operating.

Hence, in this art, an electrical connector with an improve handling portion to overcome the above-mentioned disadvantages of the prior art should be provided.

BRIEF SUMMARY OF THE INVENTION

A primary object, therefore, of the present invention is to provide a electrical connector with an improved handling structure.

In order to implement the above object, an electrical connector comprises a housing, a plurality of contacts received in the housing, a shielding and a handling portion. The housing comprises a mating portion and a connecting portion. The shielding comprises a first upper cover and a second down cover respectively assembled on the housing from up to down and from down to up. The upper cover and the down cover respectively comprises a pair of extending arm to combine to form a fastening portion located on the two sides of the shielding. The handling portion is fixed on the fastening portion and comprises a connecting element, and a cover over mode on the connecting element, a pair of fastening arms inserted into the fastening portion of the shielding. The cover is apart from the housing.

Other objects, advantages and novel features of the invention will become more apparent from the following detailed description of a preferred embodiment when taken in conjunction with the accompanying drawings.

DETAILED DESCRIPTION OF THE INVENTION

Reference will now be made in detail to a preferred embodiment of the present invention.

Figure 1:
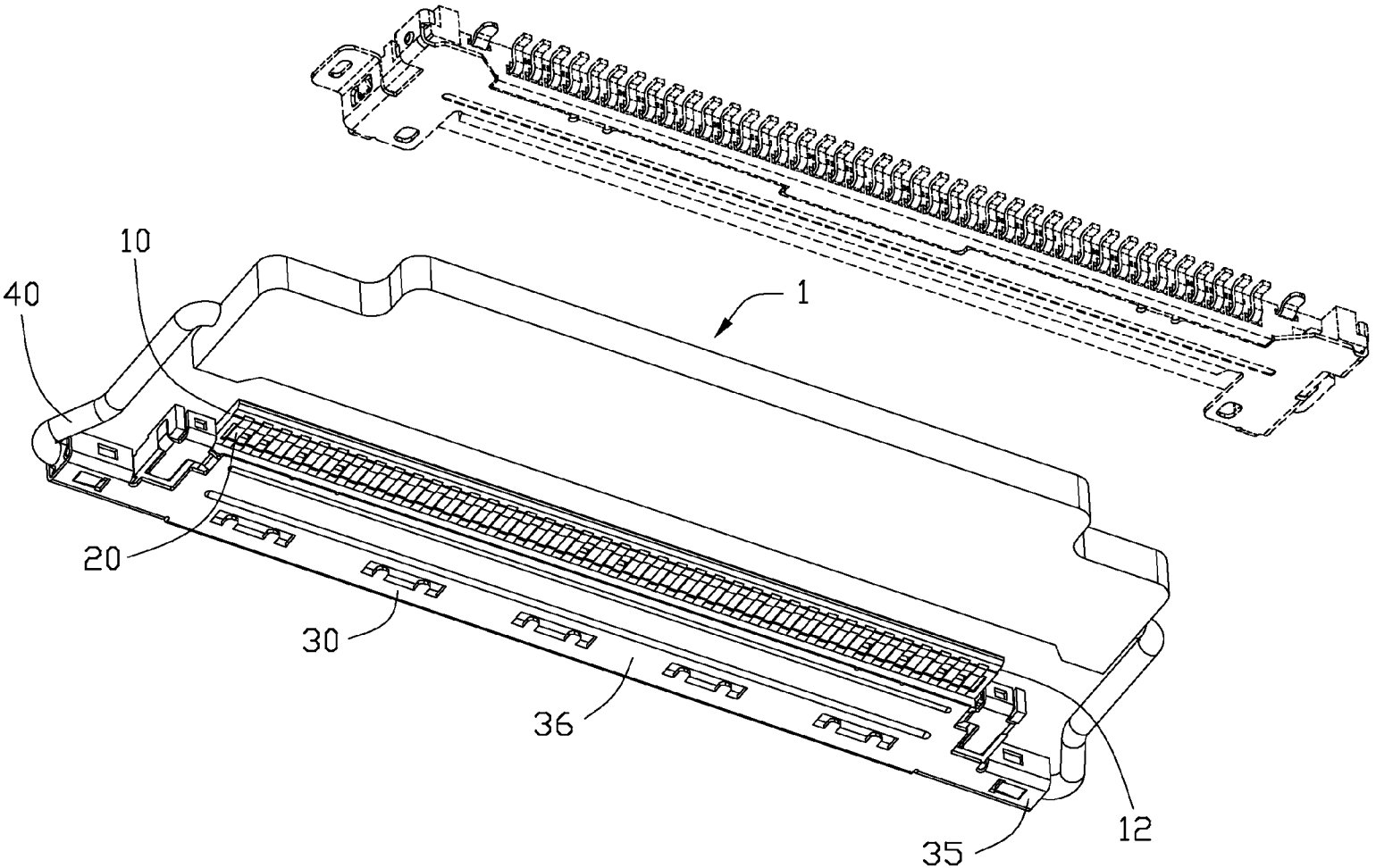
FIG. 1 is a perspective view of an electrical connector in according with a first embodiment of the present invention.
Figure 2:
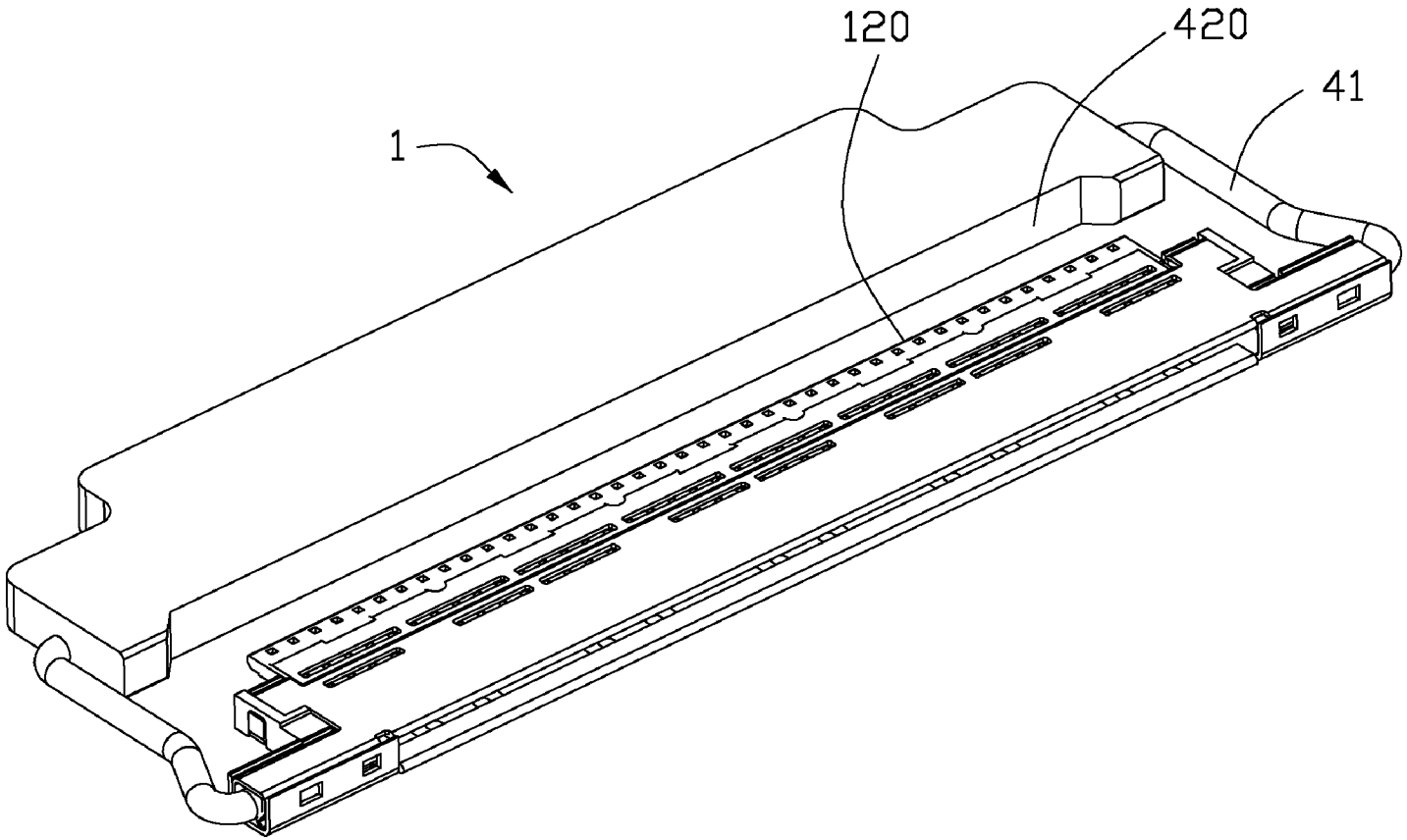
FIG. 2 is a view similar to FIG. 1, but taken from a different aspect.
Figure 3:
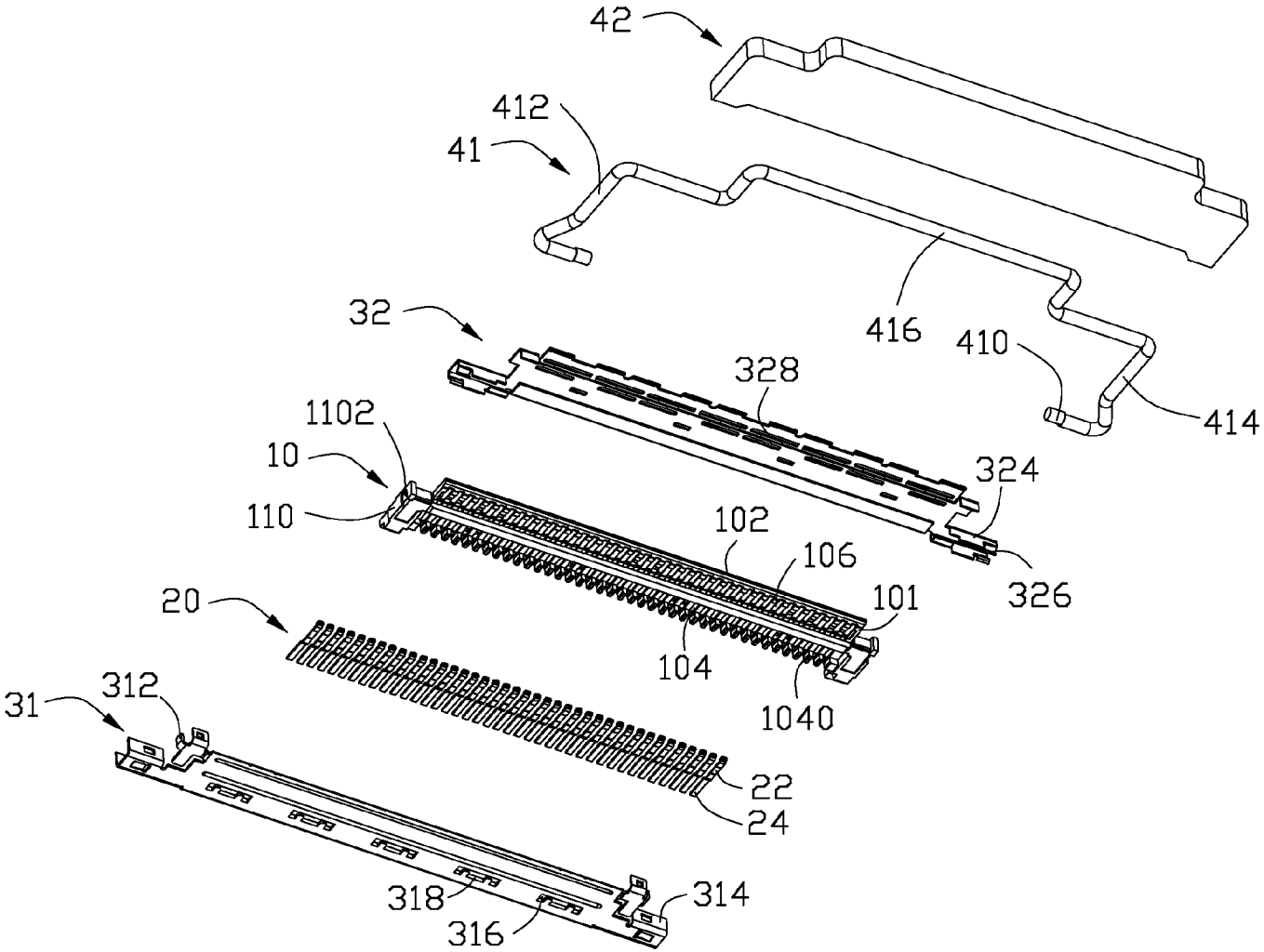
FIG. 3 is an exploded, perspective view of the electrical connector in according with the first embodiment of the present invention.

Reference to FIG. 1 to FIG. 3, an electrical connector 1 in according with a first embodiment of the present invention is shown. The electrical connector 1 comprises a housing 10, a plurality of contacts 20, a metal shielding 30 assembled on the housing 10, and a handling portion 40 attached on the shielding 30.

The housing 10 comprises a main body 101, a pair of supporting arms 110 extending from the two sides of the main body 101. The main body 101 comprises a mating portion/mating region 102, a connecting portion 104 rearward extending from the mating portion/mating region 102 and a plurality of receiving slots 106 respectively passing through the connecting portion 104 and the mating portion/mating region 102 to receive the contacts 20. A plurality of protrusions 1040 are rearward extending from the rear wall of the connecting portion 104 and every two of the protrusions 1040 are arranged on the two sides of the tail of the slots 106.

Each one of the contacts 20 comprises a mating piece 22 connected to a complementary connector, and a connecting piece 24 connected to cables (not shown).

The shielding 30 comprises a first upper cover 31 and a second down cover 32. The first cover 31 and the second cover 32 are respectively assembled on the housing from upside and downside. The shielding 30 comprises a few of pins 312 and the housing 10 defines some holes to match the pins 312 of the shielding 30 and receive the pins 312 for fastening the shielding 30 on the housing 10. The shielding 30 covers the housing 10 expect the front portion of the mating portion 102 is exposed out the shielding 30. The first upper cover 31 defines a plurality of holes 316 each with a spring patch 318 extending toward the housing 10 to attach the cable. The second down cover 32 comprises a plurality of slots 328 arranged along two lines. The first cover 31 and the second cover 32 respectively comprise a pair of extending arms 314, 324, and the down extending arms 324 are inserted into the upper extending arms 314 to form a pair of fastening portion 35 with receiving spaces on the two sides of the shielding 30. The shielding 30 defines a securing region 36 around a rear long side of the housing, from which the pair of fastening portions 35 extend outwardly and oppositely in the longitudinal direction.

The handling portion 40 moveable, in a rotational manner, between a front locking position, wherein the handling portion 40 is located in front of the mating portion 102, and a rear pulling position, where the handling portion 40 is located behind the connecting portion 104, comprises a connecting element 41 and a cover 42 attached on the connecting element 41. The connecting element 41 is made from metal and comprises an L-shape first arm 412, an L-shape second arm 414, a U-shape third arm 416 connecting the first arm 412 to the second arm 414, and a pair of tails 410 respectively extending from the first arm 412 and the second arm 414 toward the housing 10. The tails 410 are respectively received in the fastening portion 35 of the shielding 30 and each of the down extending arm 324 has a pair of arc patch 326 to firmly fix the tails 40 in the fastening portion 35. The cover 42 is made from insulation material and over molded on the third arm 416. A cutout 420 is formed on one side of the cover 42 which faces to the housing 10. The cutout 420 is longer than the mating portion 102 to ensure there is enough space between the housing and the cover 42 for the cover 42 turn around the housing 10. In assembly, the cover 42 is over molded on the third arm 416 of the connecting element 41 firstly, and then the connecting element 41 with the cover 42 is fastened on the housing 10.

Figure 4:
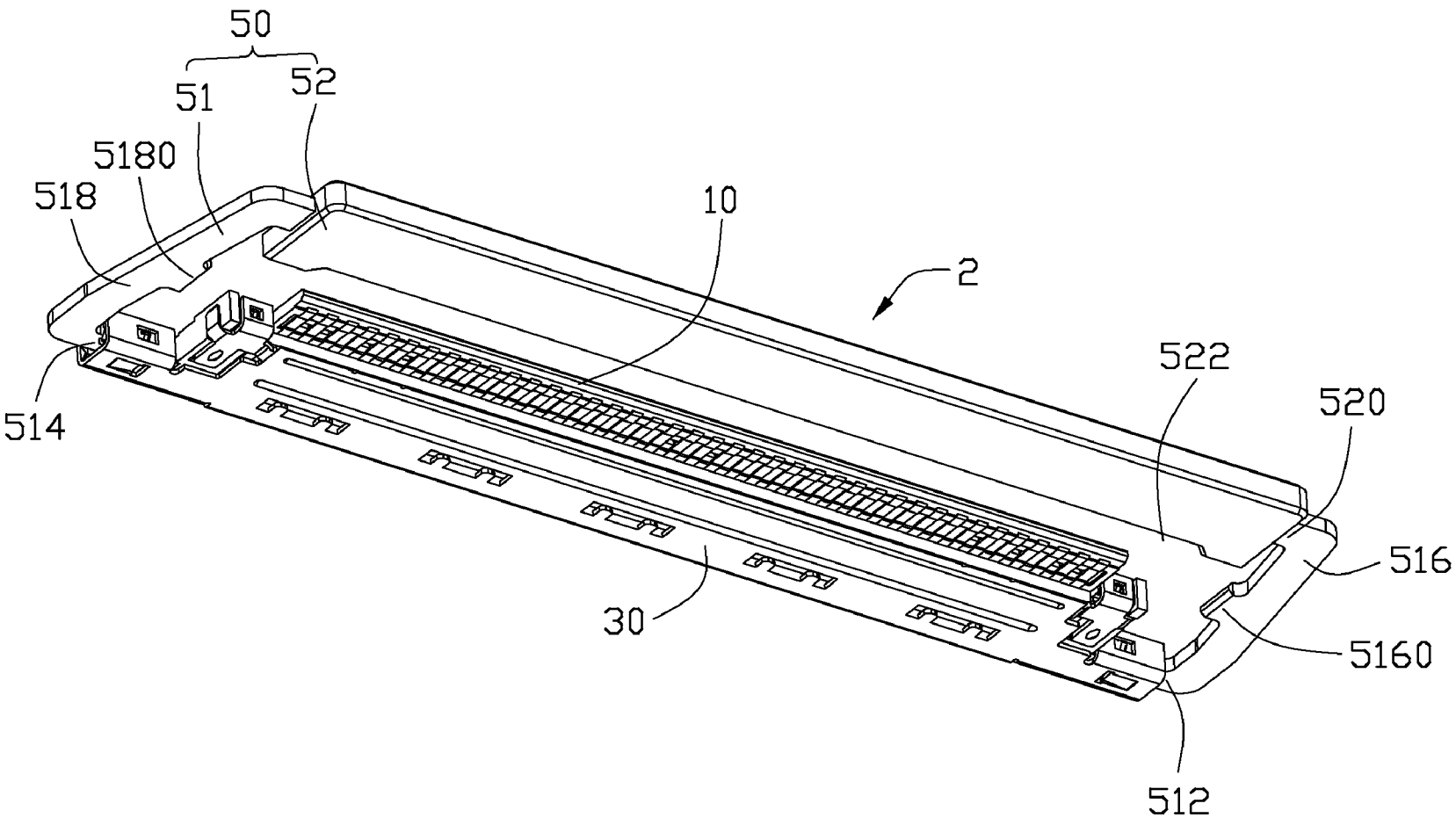
FIG. 4 is a perspective view of an electrical connector in according with a second embodiment of the present invention.

Reference to FIG. 4, an electrical connector 2 in according with a second embodiment of the present invention is shown. The difference between the two electrical connector of the first embodiment and the second embodiment is the electrical connector of the second embodiment defines a handling portion 50 different from the electrical connector of the first embodiment. The handling portion 50 comprises a connecting portion 51 and a cover 52. The connecting portion 51 is flat and substantially of U shape. The connecting portion 51 comprises a pair of tails 512, 514, a first side arm 516 connected to the tail 512, a second side arm 518 connected to the tail 514 and a third side arm 520 connecting the first side arm 516 to the second side arm 518. The first side arm 516 and the second side arm 518 respectively comprises a protrusion 5160, 5180. The two protrusions 5160, 5180 are respectively located on the middle of the side arms 516, 518 so that when a complementary connector (as shown with the dashed lines in FIG. 1) connected to the electrical connector 2, the protrusion 5160, 5180 can attach on the complementary connector. The cover 52 is over mode on the third side arm 520 of the connecting portion 51 and is substantially of rectangular shape. The cover defines a cutout 522 facing to the housing 10 of the electrical connector. In assembly, the cover 52 is over mode on the connecting portion 51 firstly, and the connecting portion 51 with the cover 52 is assembled on the housing 10. In other embodiment, the cover can be designed to other shapes in need, and the when the electrical connector connected to normal cables expect micro coaxial cables, the holes 316 and the spring patch 318 of the first upper cover 31 can be not existent.

While the foregoing description includes details which will enable those skilled in the art to practice the invention, it should be recognized that the description is illustrative in nature and that many modifications and variations thereof will be apparent to those skilled in the art having the benefit of these teachings. It is accordingly intended that the invention herein be defined solely by the claims appended hereto and that the claims be interpreted as broadly as permitted by the prior art.

What is claimed is:

1. An electrical connector, comprising:

a housing comprising a mating portion and a connecting portion;

a plurality of contacts received in the housing;

a shielding comprising a first upper cover and a second down cover respectively assembled on the housing from up to down and from down to up, the upper cover and the down cover respectively comprising a pair of extending arms to combine to form a fastening portion located on the two sides of the shielding; and a handling portion fixed on the fastening portion and comprising a connecting element, and a cover over molded on the connecting element, a pair of fastening arms inserted into the fastening portion of the shielding; wherein said cover of the handling portion is apart from the housing, said cover of the handling portion is made from insulation material and over molded on the handling portion, the cover of the handling portion has a cutout facing to the housing and formed on one side thereof.

2. The electrical connector as claimed in claim 1 said connecting element comprises an L-shape first arm, an L-shape second arm, a U-shape third arm connecting the first arm to the second arm, and a pair of tails respectively extending from the first arm and the second arm toward the housing.

3. The electrical connector as claimed in claim 2, wherein said tails are respectively received in the fastening portion of the shielding, and each of the down extending arm has a pair of arc patch to firmly fix the tails in the fastening portion.

4. The electrical connector as claimed in claim 3, wherein said cutout is longer than the mating portion to ensure there is enough space between the housing and the cover for the cover turn around the housing.

5. The electrical connector as claimed in claim 4, wherein connecting element is flat and substantially of U shape, the connecting element comprises a pair of tails, a first side arm connected to the tail, a second side arm connected to the tail and a third side arm connecting the first side arm to the second side arm.

6. The electrical connector as claimed in claim 5, wherein said first side arm and the second side arm respectively comprises a protrusion, the two protrusions respectively located on the middle of the two side arms so that when a complementary connector connected to the electrical connector, the protrusion can attach on the complementary connector.

7. The electrical connector as claimed in claim 6, wherein said cover is substantially of rectangular shape, and defines a cutout facing to the housing of the electrical connector.

8. An electrical connector for mating with a complementary connector, comprising:

an insulative housing defining front and rear long sides along a longitudinal direction and right and left short side along a transverse direction perpendicular to said longitudinal direction;

a mating region formed on the front long side;

a securing region formed around the rear long side; and an essentially U-shaped handling portion having a connecting element which is pivotally fixed to the securing region between opposite front locking position and rear pulling position and includes opposite side arms essentially extending respectively along said left and right short sides, the connection element further including a elongated bar linked between the opposite arms;

the handling portion further including an insulative cover piece being discrete from while attached on the elongated bar and having a widened dimension in said transverse direction larger than a cross-sectional dimension of the elongated bar; wherein said cover piece is dimensioned large enough to provide sufficient holding area for easy manual operation and also small enough not to interfere with the complementary connector when mated with the complementary connector which is essentially located between the elongated bar and the housing in said transverse direction under condition that said handling portion is located at the front locking position.

9. The electrical connector as claimed in claim 8, wherein said cover piece is not rotatable relative to the elongated bar.

10. The electrical connector as claimed in claim 8, wherein the connection element essentially defines a round cross-section.

11. The electrical connector as claimed in claim 8, wherein said connection element essentially defines a rectangular cross-section.

12. The electrical connector as claimed in claim 8, wherein either the connection element or the cover piece defines a retention element for engagement with the mating connector when the handling portion is located at the locking position.

13. The electrical connector as claimed in claim 8, wherein the securing region is formed by a metallic shell enclosing said housing.

* * * * *